US010667653B1

(12) United States Patent
Brown

(10) Patent No.: US 10,667,653 B1
(45) Date of Patent: Jun. 2, 2020

(54) BATHROOM SCRUBBING APPARATUS

(71) Applicant: Deborah Brown, Miami, FL (US)

(72) Inventor: Deborah Brown, Miami, FL (US)

( * ) Notice: Subject to any disclaimer, the term of this patent is extended or adjusted under 35 U.S.C. 154(b) by 0 days.

(21) Appl. No.: 15/429,619

(22) Filed: Feb. 10, 2017

(51) Int. Cl.

| | |
|---|---|
| ***B25G 1/04*** | (2006.01) |
| ***A47K 3/00*** | (2006.01) |
| ***A47K 3/28*** | (2006.01) |
| ***B25G 3/38*** | (2006.01) |
| *A47L 13/20* | (2006.01) |

(52) U.S. Cl.
CPC ..... *A47K 3/001* (2013.01); *A47K 3/281* (2013.01); *B25G 1/04* (2013.01); *B25G 3/38* (2013.01); *A47L 13/20* (2013.01)

(58) Field of Classification Search
CPC . A46B 5/02; A47L 13/04; A47L 13/20; A47L 13/258; A47L 13/16
USPC ..... 15/210.1, 228, 176.3, 244.1, 209.1, 15/229.13, 229.11, 244.2, 244.3, 144.1
See application file for complete search history.

(56) References Cited

U.S. PATENT DOCUMENTS

| | | | | |
|---|---|---|---|---|
| 5,323,506 | A | 6/1994 | Babitch | |
| 5,887,314 | A | 3/1999 | Jordan, Jr. | |
| 7,490,383 | B1 | 2/2009 | Dean | |
| 7,603,780 | B2 * | 10/2009 | Oikarinen | B25G 1/06 15/144.2 |
| 7,856,691 | B2 * | 12/2010 | Viggiani | B05C 1/06 15/118 |
| 2004/0031119 | A1 * | 2/2004 | McKay | A47L 13/18 15/227 |
| 2005/0060827 | A1 * | 3/2005 | James | A47L 13/20 15/144.2 |
| 2005/0204496 | A1 * | 9/2005 | Hillenbrand | A46B 5/0033 15/160 |
| 2009/0265872 | A1 * | 10/2009 | Eldessouky | A47L 13/254 15/144.1 |
| 2015/0259178 | A1 * | 9/2015 | Rosenbaum | B66B 31/003 134/6 |
| 2017/0282348 | A1 * | 10/2017 | Mark | B25G 1/04 |

* cited by examiner

*Primary Examiner* — Michael D Jennings

(57) ABSTRACT

A bathroom scrubbing apparatus including a telescopic shaft and a locking mechanism disposed on the telescopic shaft. A clamping member is attached to a front end of the telescopic shaft, and a pair of semi-flexible clamps is attached to the clamping member. At least one scrubbing pad member includes an upper support member, a scrubbing pad, and a handle attachment member. The scrubbing pad is disposed on a lower surface of the upper support member, and the handle attachment member is attached to a upper surface of the upper support member. The handle attachment member of the at least one scrubbing pad member is selectively removable and rotatable within the pair of semi-flexible clamps.

4 Claims, 5 Drawing Sheets

10
20
22
24
26
28
28
28
32
34
36
40
42
46
48
48
50
50
52
52

BATHROOM SCRUBBING APPARATUS

BACKGROUND OF THE INVENTION

Various types of cleaning apparatuses are known in the prior art. However, what has been needed is a bathroom scrubbing apparatus including a telescopic shaft and a locking mechanism disposed on the telescopic shaft. What has been further needed is a clamping member attached to the front end of the telescopic shaft, a pair of semi-flexible clamps attached to the clamping member, and at least one scrubbing pad member including an upper support member, a scrubbing pad, and a handle attachment member. Lastly, what has been further needed is for the handle attachment member of the at least one scrubbing pad member to be selectively removable and rotatable within the pair of semi-flexible clamps. The bathroom scrubbing apparatus thus helps a user to more easily clean a tub and a shower through the use of the telescopic shaft and the rotatable and removable scrubbing pad member. The bathroom scrubbing apparatus is particularly well suited for those users with disabilities or injuries that prevent them from stretching or bending over a tub and a shower.

FIELD OF THE INVENTION

The present invention relates to cleaning apparatuses, and more particularly, to a bathroom scrubbing apparatus.

SUMMARY OF THE INVENTION

The general purpose of the present bathroom scrubbing apparatus, described subsequently in greater detail, is to provide a bathroom scrubbing apparatus which has many novel features that result in a bathroom scrubbing apparatus which is not anticipated, rendered obvious, suggested, or even implied by prior art, either alone or in combination thereof.

To accomplish this, the present bathroom scrubbing apparatus includes a telescopic shaft having a front end, a rear end, and a handle disposed on the rear end. A locking mechanism is disposed on the telescopic shaft, with the locking mechanism configured to selectively lock the telescopic shaft at one of a plurality of lengths. A single continuous substantially C-shaped clamping member has an upper arm, a lower arm, and a middle arm disposed between the upper arm and the lower arm. Each of the upper arm and the lower arm has a front side. The middle arm is medially attached to the front end of the telescopic shaft, and each of the upper arm and the lower arm is forwardly extended from the front end. Each of an upper clamp and a lower clamp of a pair of curved C-shaped semi-flexible clamps is attached to the front side of each of the upper arm and the lower arm, respectively, of the single continuous substantially C-shaped clamping member.

The bathroom scrubbing apparatus further includes at least one scrubbing pad member. The at least one scrubbing pad member further includes a substantially rectangular upper support member, a scrubbing pad, and an inverted U-shaped handle attachment member. The substantially rectangular upper support member has an upper surface and a lower surface. The scrubbing pad is disposed on the lower surface of the substantially rectangular upper support member, and the inverted U-shaped handle attachment member is medially attached to the upper surface of the substantially rectangular upper support member. The scrubbing pad is optionally a foam material. The inverted U-shaped handle attachment member of the at least one scrubbing pad member is selectively removable and rotatable within the pair of curved C-shaped semi-flexible clamps.

The at least one scrubbing pad member is optionally a pair of scrubbing pad members including a first scrubbing pad member and a second scrubbing pad member. A length of each of the substantially rectangular upper support member and the scrubbing pad of the first scrubbing pad member is shorter than a length of each of the substantially rectangular upper support member and the scrubbing pad of the second scrubbing pad member. The varying lengths between the first scrubbing pad member and the second scrubbing pad member allows a user to more easily clean various parts of a tub and, alternately, a shower, depending on how much surface area of the scrubbing pad is needed. The telescopic shaft also allows the user to easily adjust a length of the shaft to more easily clean an inner surface of a tub and, alternately, a shower. Lastly, a left side of the substantially rectangular upper support member of each of the first scrubbing pad member and the second scrubbing pad member is optionally concavely curved inward towards the inverted U-shaped handle attachment member so that the scrubbing pad can more easily wrap around the fixtures within the tub and, alternately, the shower.

Thus has been broadly outlined the more important features of the present bathroom scrubbing apparatus so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
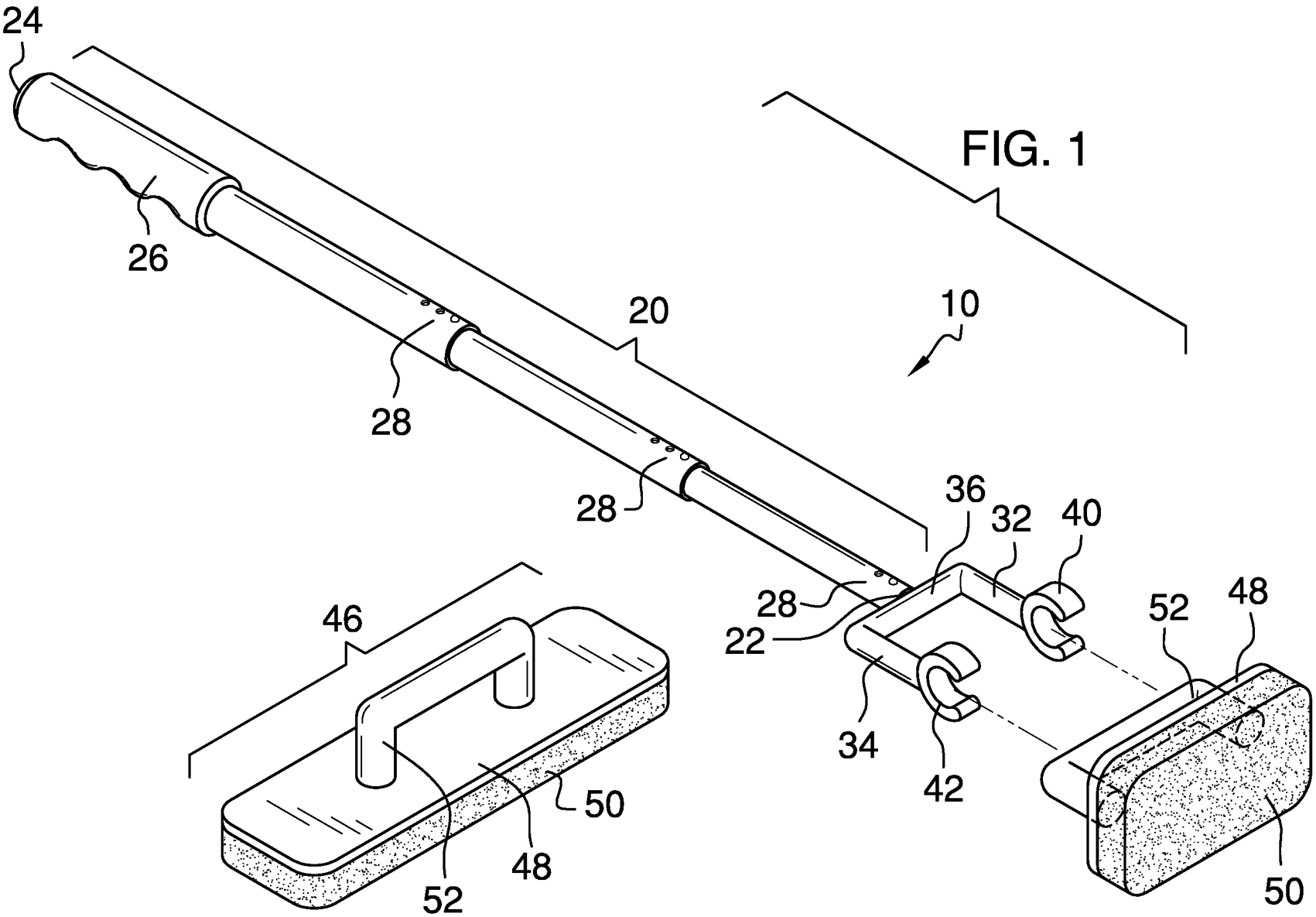
FIG. 1 is a front isometric view.
Figure 2:
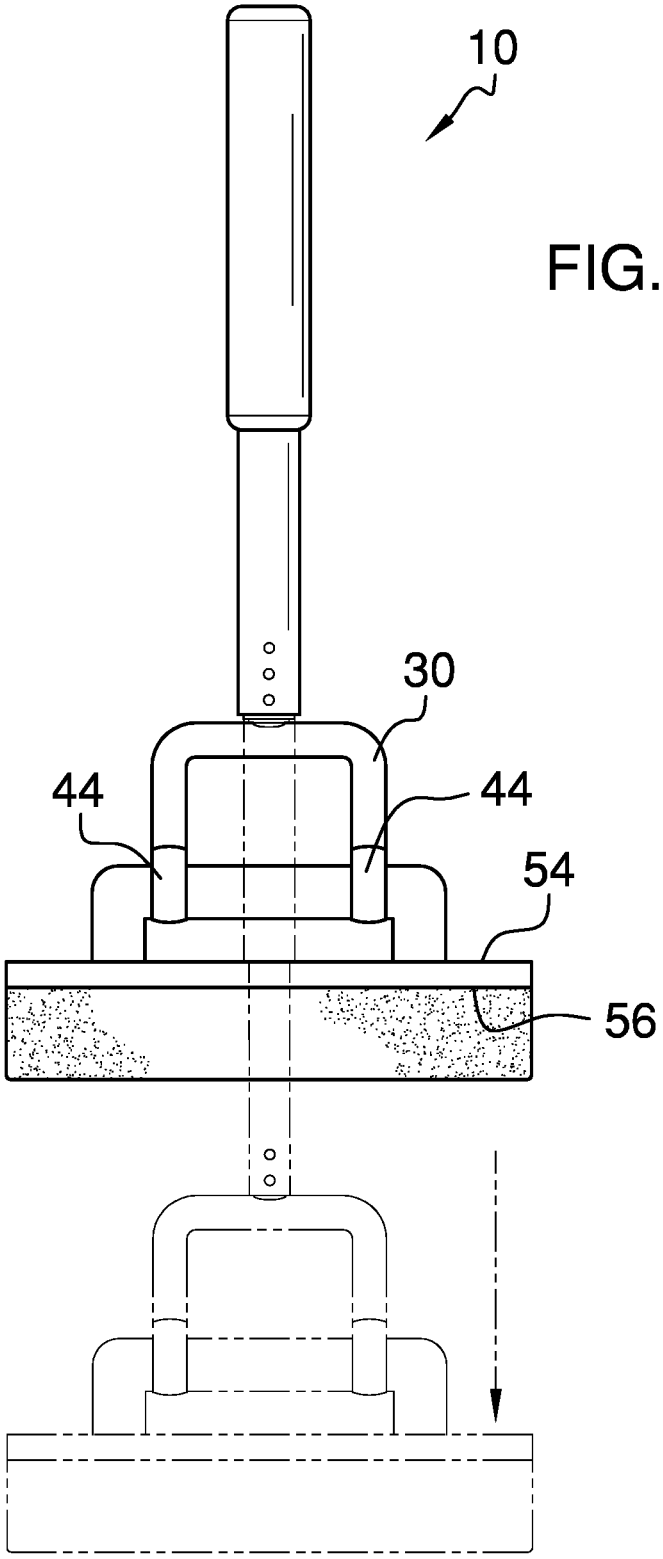
FIG. 2 is a front elevation view.
Figure 3:
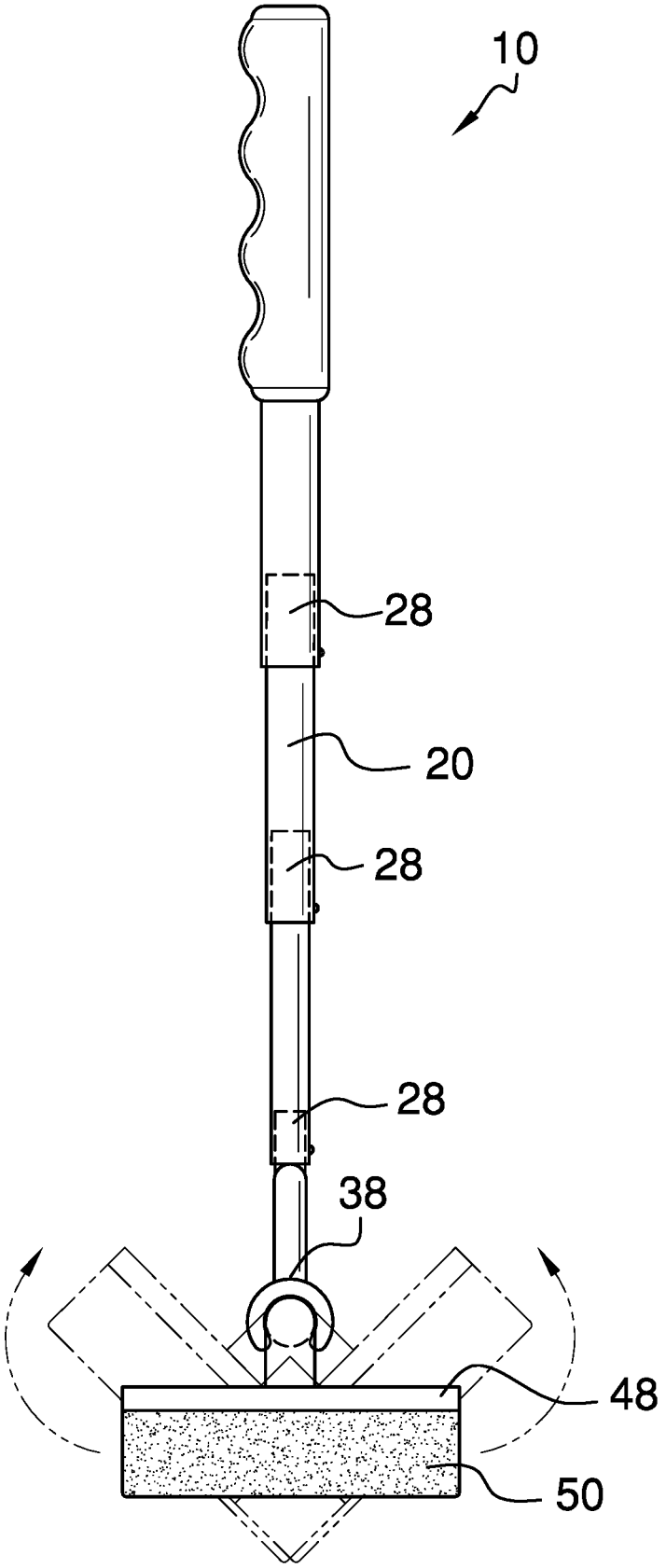
FIG. 3 is a side elevation view.
Figure 4:
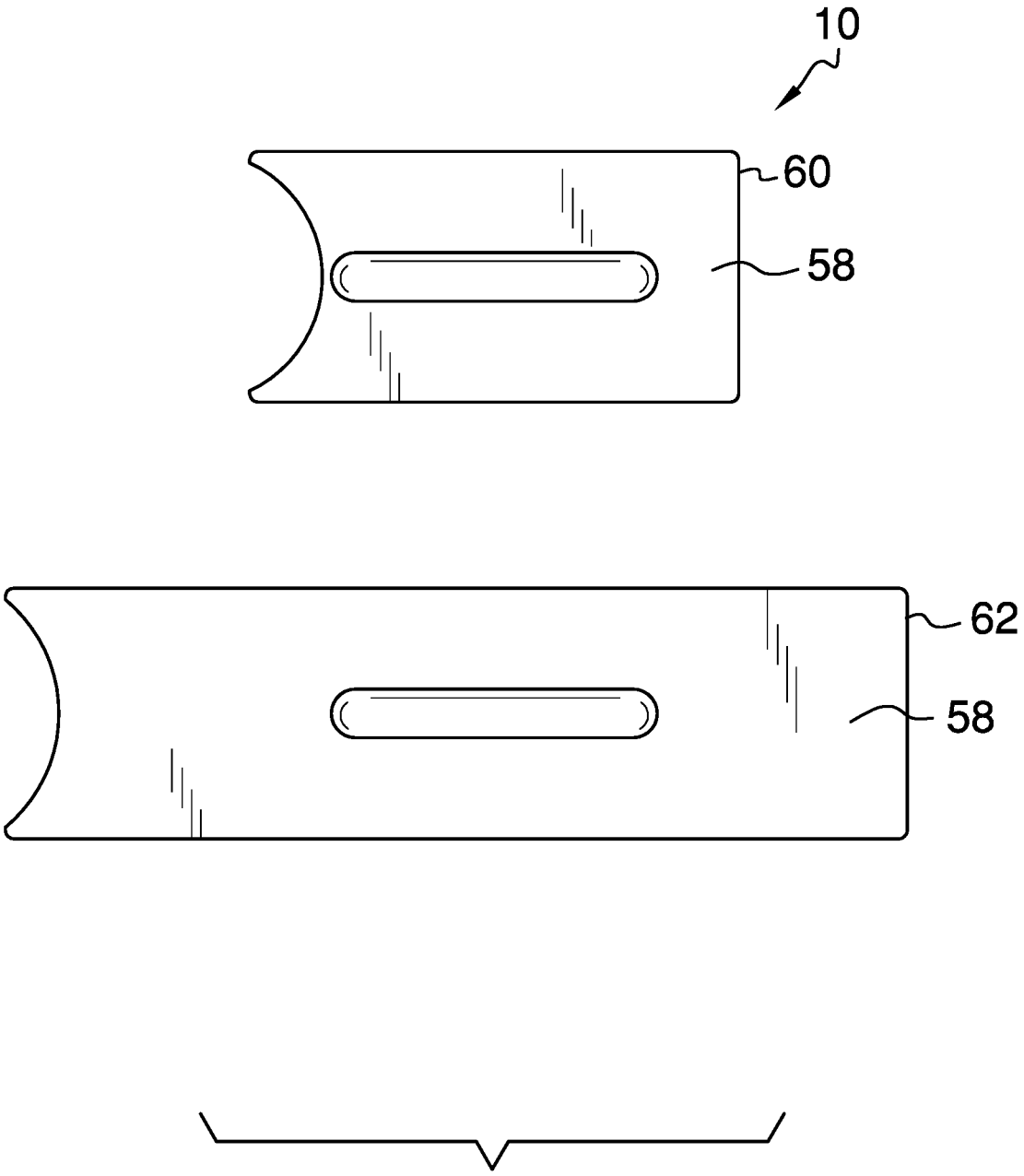
FIG. 4 is a top plan view.
Figure 5:
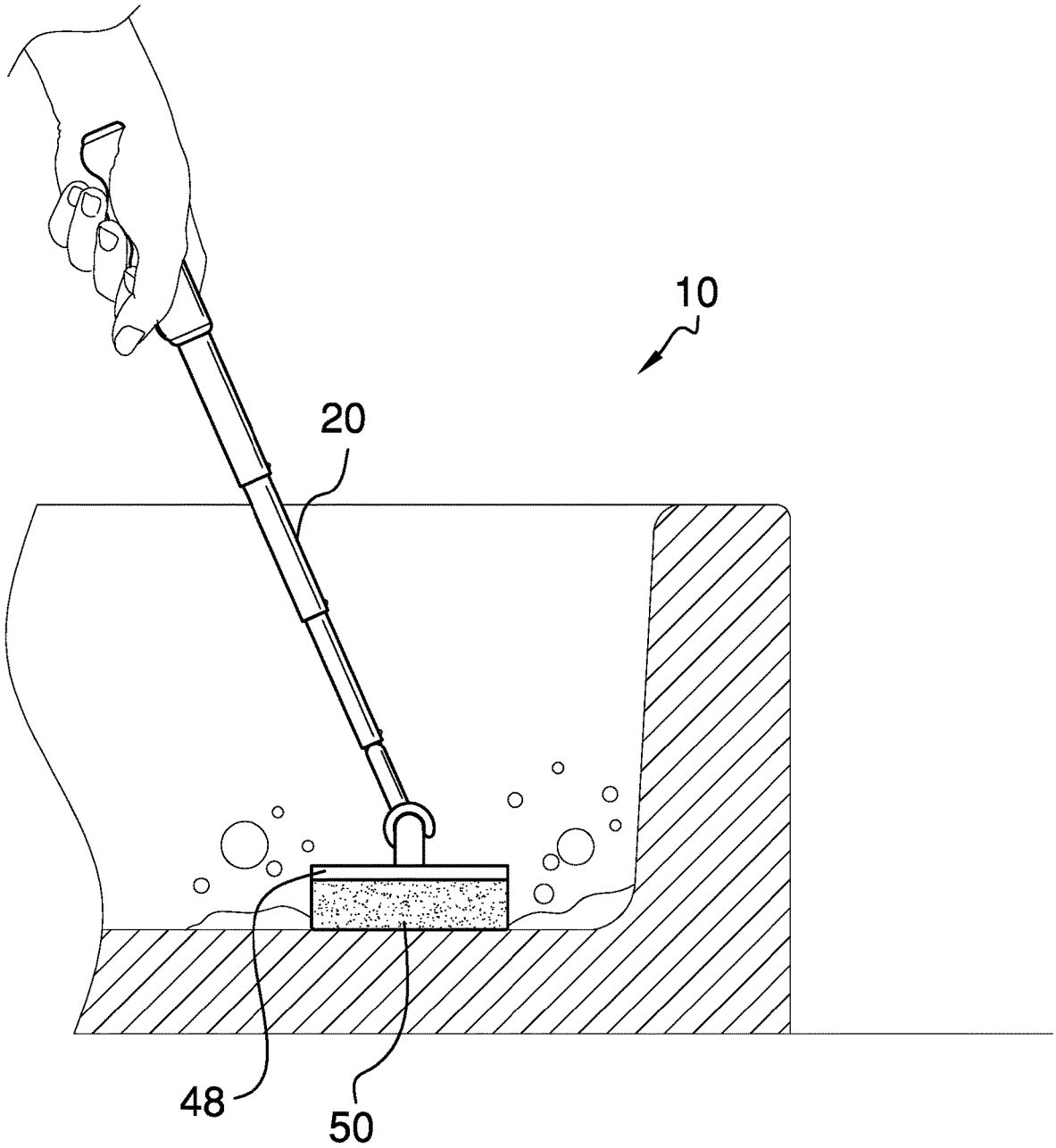
FIG. 5 is an in use view.

With reference now to the drawings, and in particular FIGS. 1 through 5 thereof, an example of the instant bathroom scrubbing apparatus employing the principles and concepts of the present bathroom scrubbing apparatus and generally designated by the reference number 10 will be described.

Referring to FIGS. 1 through 5 the present bathroom scrubbing apparatus 10 is illustrated. The bathroom scrubbing apparatus 10 includes a telescopic shaft 20 having a front end 22, a rear end 24, and a handle 26 disposed on the rear end 24. A locking mechanism 28 is disposed on the telescopic shaft 20. A single continuous substantially C-shaped clamping member 30 has a first arm 32, a second arm 34, and a middle arm 36 disposed between the first arm 32 and the second arm 34. Each of the first arm 32 and the second arm 34 has a front side 38. The middle arm 36 is medially attached to the front end 22 of the telescopic shaft 20, and each of the first arm 32 and the second arm 34 is forwardly extended from the front end 22. Each of a first clamp 40 and a second clamp 42 of a pair of curved C-shaped semi-flexible clamps 44 is attached to the front side 38 of each of the first arm 32 and the lower arm 34, respectively, of the single continuous substantially C-shaped clamping member 30.

The bathroom scrubbing apparatus 10 further includes at least one scrubbing pad member 46. The at least one scrubbing pad member 46 further includes a substantially rectangular upper support member 48, a scrubbing pad 50, and an inverted U-shaped handle attachment member 52. The substantially rectangular upper support member 48 has an upper surface 54 and a lower surface 56. The scrubbing pad 50 is disposed on the lower surface 56 of the substantially rectangular upper support member 48, and the inverted U-shaped handle attachment member 52 is medially attached to the upper surface 54 of the substantially rectangular upper support member 48. The inverted U-shaped handle attachment member 52 of the at least one scrubbing pad member 46 is selectively removable and rotatable within the pair of curved C-shaped semi-flexible clamps 44.

The at least one scrubbing pad member 46 is optionally a pair of scrubbing pad members 58 including a first scrubbing pad member 60 and a second scrubbing pad member 62. A left side 64 of the substantially rectangular upper support member 48 of each of the first scrubbing pad member 60 and the second scrubbing pad member 62 is optionally concavely curved inward towards the inverted U-shaped handle attachment member 52.

What is claimed is:

1. A bathroom scrubbing apparatus comprising:

a telescopic shaft having a front end, a rear end, and a handle disposed on the rear end;

a locking mechanism disposed on the telescopic shaft, the locking mechanism configured to selectively lock the telescopic shaft at one of a plurality of lengths;

a single continuous substantially C-shaped clamping member having a first arm, a second arm, and a middle arm disposed between the first arm and the second arm, each of the first arm and the second arm having a front side, wherein the middle arm is medially attached to the front end of the telescopic shaft and each of the first arm and the second arm is forwardly extended from the front end;

a pair of curved C-shaped semi-flexible clamps comprising a first clamp and a second clamp, wherein each of the first clamp and the second clamp is attached to the front side of each of the first arm and the second arm, respectively, of the single continuous substantially C-shaped clamping member; and at least one scrubbing pad member further comprising:

a substantially rectangular upper support member having an upper surface and a lower surface;

a scrubbing pad disposed on the lower surface of the substantially rectangular upper support member; and an inverted U-shaped handle attachment member medially attached to the upper surface of the substantially rectangular upper support member;

wherein the inverted U-shaped handle attachment member of the at least one scrubbing pad member is selectively removable and rotatable within the pair of curved C-shaped semi-flexible clamps.

2. The bathroom scrubbing apparatus of claim 1 wherein the at least one scrubbing pad member is a pair of scrubbing pad members comprising a first scrubbing pad member and a second scrubbing pad member, the second scrubbing pad member being interchangeably couplable to the C-shaped semi-flexible clamps.

3. The bathroom scrubbing apparatus of claim 2 wherein a length of each of the substantially rectangular upper support member and the scrubbing pad of the first scrubbing pad member is shorter than a length of each of the substantially rectangular upper support member and the scrubbing pad of the second scrubbing pad member.

4. The bathroom scrubbing apparatus of claim 3 wherein a left side of the substantially rectangular upper support member of each of the first scrubbing pad member and the second scrubbing pad member is concavely curved inward towards the inverted U-shaped handle attachment member.

* * * * *